US009616658B2

(12) United States Patent
Suzuki et al.

(10) Patent No.: US 9,616,658 B2
(45) Date of Patent: Apr. 11, 2017

(54) LIQUID EJECTING APPARATUS

(71) Applicant: BROTHER KOGYO KABUSHIKI KAISHA, Nagoya-shi, Aichi-ken (JP)

(72) Inventors: Katsuaki Suzuki, Nagoya (JP); Katsunori Sakai, Toyokawa (JP); Motohiro Tsuboi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/166,358

(22) Filed: May 27, 2016

(65) Prior Publication Data

US 2016/0347058 A1 Dec. 1, 2016

(30) Foreign Application Priority Data

May 29, 2015 (JP) ..... 2015-110499

(51) Int. Cl.
*B41J 2/045* (2006.01)

(52) U.S. Cl.
CPC ..... *B41J 2/04516* (2013.01); *B41J 2/04586* (2013.01); *B41J 2/04588* (2013.01); *B41J 2/04596* (2013.01)

(58) Field of Classification Search
CPC B41J 2/04516; B41J 2/04588; B41J 2/04596; B41J 2/04541
See application file for complete search history.

(56) References Cited

U.S. PATENT DOCUMENTS

| | | | |
|---|---|---|---|
| 5,992,968 | A | 11/1999 | Uetsuki et al. |
| 6,299,270 | B1 | 10/2001 | Merrill |
| 2006/0001685 | A1 | 1/2006 | Freire |
| 2006/0274098 | A1 | 12/2006 | Shibata et al. |

FOREIGN PATENT DOCUMENTS

| | | | | |
|---|---|---|---|---|
| JP | H08-58083 | A | | 3/1996 |
| JP | 2000-203012 | A | | 7/2000 |
| JP | 2006-015747 | A | | 1/2006 |
| JP | 2006-341406 | A | | 12/2006 |
| JP | 2009-285922 | A | | 12/2009 |
| JP | 2014004686 | A | * | 1/2014 |

* cited by examiner

*Primary Examiner* — Stephen Meier
*Assistant Examiner* — Sharon A Polk
(74) *Attorney, Agent, or Firm* — Scully, Scott, Murphy & Presser, PC

(57) ABSTRACT

A waveform selecting process includes selecting one of a plurality of kinds of driving waveforms for each of a plurality of dot elements, based on a density value set to each of the plurality of dot elements in image data. The waveform selecting process includes, for a dot element array of each of the plurality of ejection ports: determining whether a dot element corresponding to a target dot has a second density value and determining whether a subsequent dot element corresponding to a subsequent dot has a first density value and, when both determinations are positive, setting the dot element corresponding to the target dot as a correction-target dot element, the subsequent dot being subsequent to the target dot in the formation order; and selecting one of a first driving waveform and a second driving waveform as a driving waveform of a correction-target dot element.

9 Claims, 10 Drawing Sheets

NON-EJECTION WAVEFORM

SMALL DROPLET WAVEFORM

MEDIUM DROPLET WAVEFORM

LARGE DROPLET WAVEFORM

EXTRA-LARGE DROPLET WAVEFORM

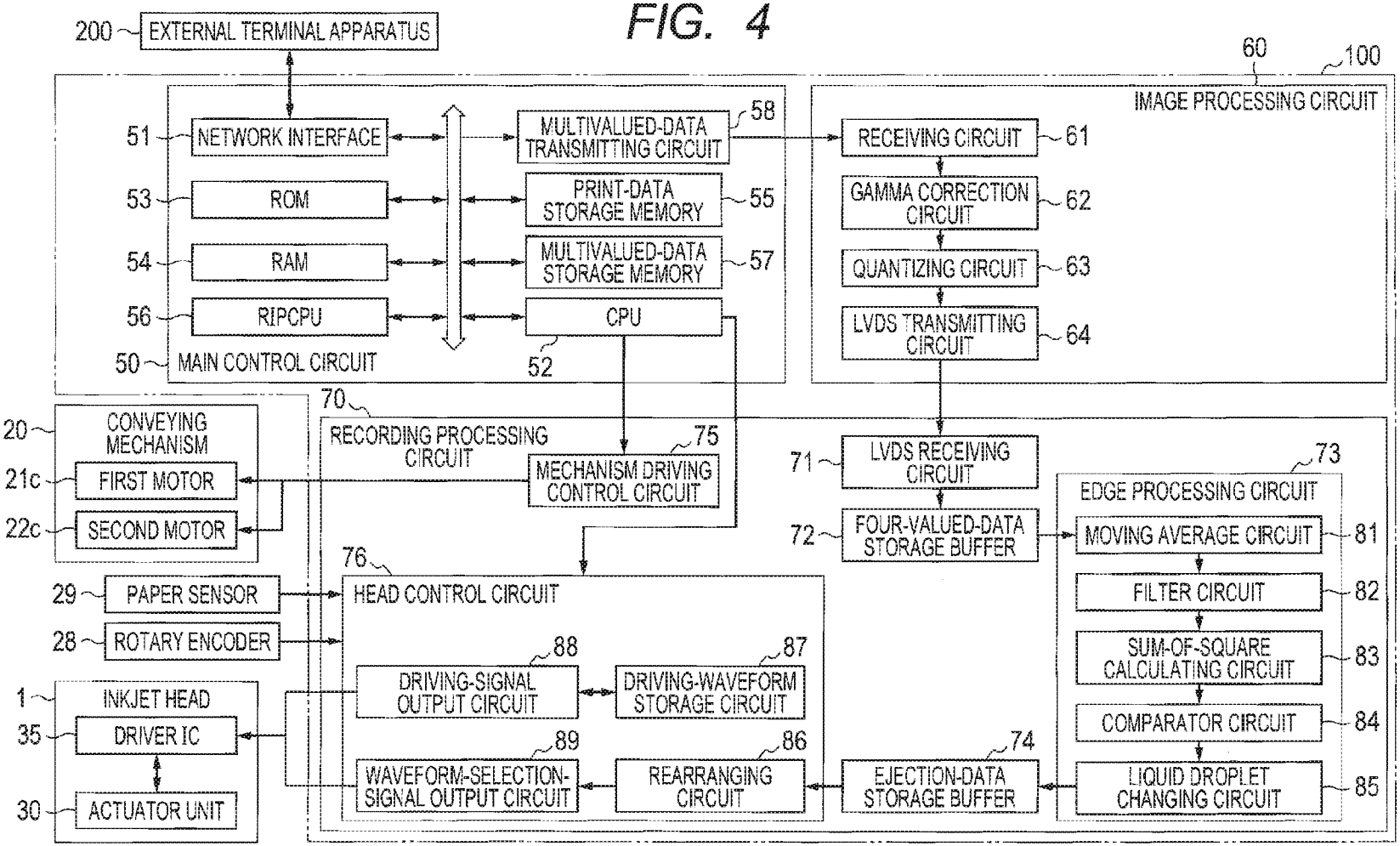
FIG. 4
EXTERNAL TERMINAL APPARATUS
200
NETWORK INTERFACE
51
ROM
53
RAM
54
RIPCPU
56
MAIN CONTROL CIRCUIT
50
MULTIVALUED-DATA TRANSMITTING CIRCUIT
58
PRINT-DATA STORAGE MEMORY
55
MULTIVALUED-DATA STORAGE MEMORY
57
CPU
52
IMAGE PROCESSING CIRCUIT
60
100
RECEIVING CIRCUIT
61
GAMMA CORRECTION CIRCUIT
62
QUANTIZING CIRCUIT
63
LVDS TRANSMITTING CIRCUIT
64
LVDS RECEIVING CIRCUIT
71
FOUR-VALUED-DATA STORAGE BUFFER
72
EDGE PROCESSING CIRCUIT
73
MOVING AVERAGE CIRCUIT
81
FILTER CIRCUIT
82
SUM-OF-SQUARE CALCULATING CIRCUIT
83
COMPARATOR CIRCUIT
84
LIQUID DROPLET CHANGING CIRCUIT
85
EJECTION-DATA STORAGE BUFFER
74
RECORDING PROCESSING CIRCUIT
70
MECHANISM DRIVING CONTROL CIRCUIT
75
HEAD CONTROL CIRCUIT
76
DRIVING-WAVEFORM STORAGE CIRCUIT
87
REARRANGING CIRCUIT
86
DRIVING-SIGNAL OUTPUT CIRCUIT
88
WAVEFORM-SELECTION-SIGNAL OUTPUT CIRCUIT
89
CONVEYING MECHANISM
20
FIRST MOTOR
21c
SECOND MOTOR
22c
PAPER SENSOR
29
ROTARY ENCODER
28
INKJET HEAD
1
DRIVER IC
35
ACTUATOR UNIT
30

FIG. 6A

FOUR-VALUED DATA

| | | | | | | |
|---|---|---|---|---|---|---|
| 01 | 01 | 00 | 01 | 01 | 01 | 01 |
| 01 | 01 | 00 | 01 | 01 | 01 | 01 |
| 01 | 01 | 00 | 01 | 01 | 01 | 01 |
| 01 | 01 | 00 | 01 | 01 | 01 | 01 |
| 01 | 01 | 00 | 01 | 01 | 01 | 01 |
| 01 | 01 | 00 | 01 | 01 | 01 | 01 |
| 01 | 01 | 00 | 01 | 01 | 01 | 01 |

ARRANGEMENT DIRECTION

TARGET DOT ELEMENT A

PROCESSING TARGET REGION

DOT ELEMENT ARRAY

FIG. 6B

AVERAGED DATA

| | | | | | | |
|---|---|---|---|---|---|---|
| 2/3 | 2/3 | 2/3 | 2/3 | 01 | 01 | 01 |
| 2/3 | 2/3 | 2/3 | 2/3 | 01 | 01 | 01 |
| 2/3 | 2/3 | 2/3 | 2/3 | 01 | 01 | 01 |
| 2/3 | 2/3 | 2/3 | 2/3 | 01 | 01 | 01 |
| 2/3 | 2/3 | 2/3 | 2/3 | 01 | 01 | 01 |
| 2/3 | 2/3 | 2/3 | 2/3 | 01 | 01 | 01 |
| 2/3 | 2/3 | 2/3 | 2/3 | 01 | 01 | 01 |

ARRANGEMENT DIRECTION

CALCULATION TARGET DOT ELEMENT AA

PROCESSING TARGET REGION

DOT ELEMENT ARRAY

FIG. 6C

SOBEL FILTER

F1

| | | |
|---|---|---|
| -1 | 0 | 1 |
| -2 | 0 | 2 |
| -1 | 0 | 1 |

FIG. 6D

SOBEL FILTER

F2

| | | |
|---|---|---|
| -1 | -2 | -1 |
| 0 | 0 | 0 |
| 1 | 2 | 1 |

FIG. 10A

EJECTION DATA

| | | | | |
|---|---|---|---|---|
| 00 | 00 | 00 | 00 | 00 |
| 00 | 00 | 11 | 11 | 00 |
| 00 | 00 | 01 | 10 | 00 |
| 00 | 00 | 11 | 10 | 00 |
| 00 | 00 | 11 | 11 | 00 |
| 00 | 00 | 00 | 11 | 00 |
| 00 | 00 | 00 | 00 | 00 |
| 00 | 00 | 00 | 00 | 00 |

ARRANGEMENT DIRECTION

DOT ELEMENT ARRAY

FIG. 10B

EJECTION DATA

| | | | | |
|---|---|---|---|---|
| 0 | 0 | 0 | 0 | 0 |
| 0 | 0 | T | T | 0 |
| 0 | 0 | S | M | 0 |
| 0 | 0 | T | M | 0 |
| 0 | 0 | L1 | T | 0 |
| 0 | 0 | | L2 | 0 |
| 0 | 0 | 0 | | 0 |
| 0 | 0 | 0 | 0 | 0 |

ARRANGEMENT DIRECTION

DOT ELEMENT ARRAY

LIQUID EJECTING APPARATUS

CROSS REFERENCE TO RELATED APPLICATIONS

This application claims priority from Japanese Patent Application No. 2015-110499 filed May 29, 2015. The entire content of the priority application is incorporated herein by reference.

TECHNICAL FIELD

This disclosure relates to a liquid ejecting apparatus.

BACKGROUND

An inkjet printer configured to eject ink droplets onto a recording medium such as paper for forming images and so on is conventionally known. In this inkjet printer, driving signals having particular driving waveforms are supplied to an inkjet head so that ink droplets are ejected from ejection ports.

In this type of inkjet recording apparatus, an ink droplet ejected from an ejection port is sometimes separated into a main droplet and a satellite droplet having a smaller volume than the main droplet. If the main droplet and the satellite droplet arrive at different positions on the recording medium, quality of the image recorded on the recording medium deteriorates.

Thus, in a known inkjet recording apparatus, in a waveform pattern supplied to the inkjet head (driving waveform), a cancel pulse for suppressing occurrence of the satellite droplet is added subsequent to an ejection pulse for ejecting an ink droplet.

SUMMARY

According to one aspect, this specification discloses a liquid ejecting apparatus. The liquid ejecting apparatus includes a liquid ejecting head, a relative moving mechanism, an image data memory, a driving waveform memory, and a controller. The liquid ejecting head has an ejection surface having a plurality of ejection ports configured to eject liquid droplets. The relative moving mechanism is configured to cause relative movement of a recording medium relative to the liquid ejecting head in a relative moving direction parallel to the ejection surface. The image data memory is configured to store image data having, for each of the plurality of ejection ports, a dot element array in which a plurality of dot elements corresponding to a plurality of dots on a recording medium is arrayed in formation order of forming the plurality of dots. The plurality of dots is formed by liquid droplets ejected from a corresponding one of the plurality of ejection ports. The image data has a dot element value for each of the plurality of dot elements. The dot element value is indicative of a total amount of liquid droplets ejected from the corresponding one of the plurality of ejection ports. The dot element value is one of a plurality of density values of which the total amount of liquid droplets is different from each other. The driving waveform memory is configured to store a plurality of kinds of driving waveforms including: a first driving waveform corresponding to a first density value of which the total amount of liquid droplets is zero, the first driving waveform being one of the plurality of density values; a second driving waveform corresponding to a density value of which the total amount of liquid droplets is larger than zero; and a third driving waveform corresponding to a second density value of which the total amount of liquid droplets is larger than zero, the second driving waveform being one of the plurality of density values, the total amount of liquid droplets by the third driving waveform being larger than the total amount of liquid droplets by the second driving waveform, the third driving waveform producing a larger amount of a satellite droplet than the second driving waveform, the satellite droplet being separated from a main droplet of a liquid droplet when the liquid droplet is ejected from one of the plurality of ejection ports. The controller is configured to control the liquid ejecting head and the relative moving mechanism. The controller is configured to perform: a relative moving process of controlling the relative moving mechanism to cause relative movement of a recording medium relative to the liquid ejecting head in the relative moving direction; a waveform selecting process of selecting one of the plurality of kinds of driving waveforms for each of the plurality of dot elements, based on a density value set to each of the plurality of dot elements in the image data, the waveform selecting process including, for the dot element array of each of the plurality of ejection ports: determining whether a dot element corresponding to a target dot has the second density value and determining whether a subsequent dot element corresponding to a subsequent dot has the first density value and, when both determinations are positive, setting the dot element corresponding to the target dot as a correction-target dot element, the subsequent dot being subsequent to the target dot in the formation order; and selecting one of the first driving waveform and the second driving waveform as a driving waveform of the correction-target dot element; and a driving-signal supplying process of supplying the liquid ejecting head with a driving signal having one of the first, second, and third driving waveforms selected for each of the plurality of dot elements by the waveform selecting process, and selectively ejecting liquid droplets from the plurality of ejection ports onto the recording medium that moves relative to the liquid ejecting head.

BRIEF DESCRIPTION OF THE DRAWINGS

Embodiments in accordance with this disclosure will be described in detail with reference to the following figures wherein:

FIG. 4 is a diagram showing the electrical configuration of the inkjet printer shown in FIG. 1;

FIG. 6A is an explanatory diagram showing four-valued data;

FIG. 6B is an explanatory diagram showing averaged data;

FIGS. 6C and 6D are explanatory diagrams each showing a Sobel filter;

FIG. 10A is an explanatory diagram showing ejection data; and

FIG. 10B is an explanatory diagram showing types of driving signals supplied to the inkjet head so as to correspond to each dot element of the ejection data.

DETAILED DESCRIPTION

Recently, in an inkjet recording apparatus, it is desired to further improve optical density of an image recorded on a recording medium. As a means for improving the optical density of an image, it is conceivable to increase the maximum amount of ink that can be ejected for one dot on a recording medium. In order to adopt this means in the above-described inkjet recording apparatus, it is necessary to increase the number of ejection pulses included in a waveform pattern having a largest ejection amount of ink, for example.

In the above-described inkjet recording apparatus, however, a cancel pulse needs to be added to the waveform pattern in order to suppress occurrence of a satellite droplet. This restricts increasing the number of ejection pulses and extending a pulse width in the waveform pattern, and consequently the optical density of an image cannot be improved sufficiently.

In view of the foregoing, an example of the object of this disclosure is to provide a liquid ejecting apparatus configured to improve the optical density of an image recorded on a recording medium and to suppress deterioration of image quality.

Figure 1:
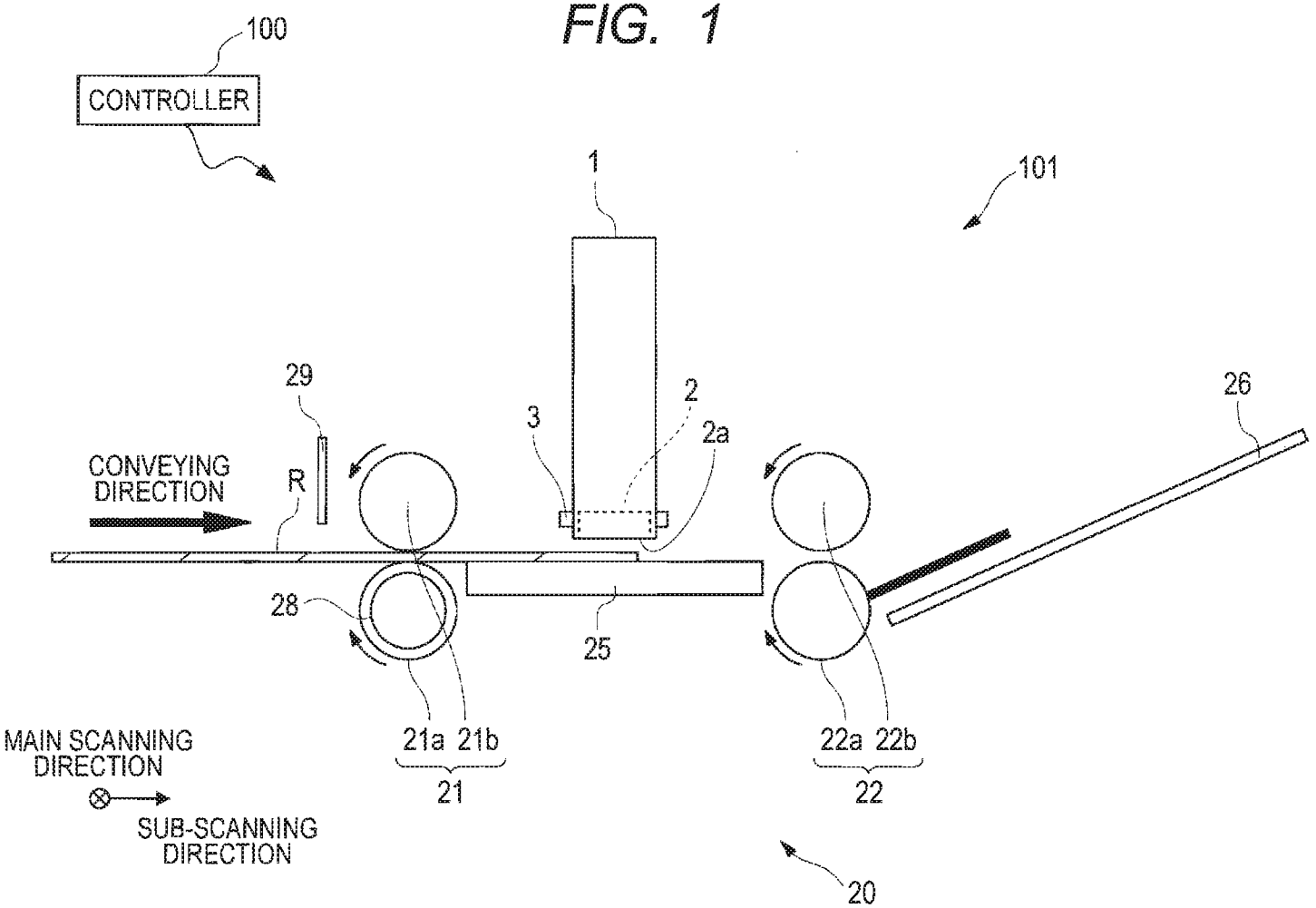
FIG. 1 is a schematic side view of an inkjet printer according to an embodiment.

Hereinafter, a liquid ejecting apparatus of this disclosure is applied to an inkjet printer. Some aspects of this disclosure will be described while referring to the accompanying drawings. As shown in FIG. 1, an inkjet printer 101 includes an inkjet head 1 (an example of liquid ejecting head), a conveying mechanism 20 (an example of relative moving mechanism), a platen 25, a paper tray 26, and a controller 100.

The conveying mechanism 20 is configured to convey paper R along a conveying direction that is parallel to an ejection surface 2*a* (described later) and that is from the left to the right in FIG. 1. The conveying mechanism 20 includes a first conveying section 21 and a second conveying section 22. The first conveying section 21 and the second conveying section 22 are arranged such that the head 1 is interposed therebetween with respect to the conveying direction of paper R.

The first conveying section 21 has a pair of conveying rollers 21*a*, 21*b* and a first motor 21*c* configured to drive the conveying rollers 21*a*, 21*b* to rotate (see FIG. 4). The pair of conveying rollers 21*a*, 21*b* is driven to rotate in different directions by the first motor 21*c* (see the arrows in FIG. 1), thereby nippingly conveying paper R supplied from a paper feeding unit (not shown) in the conveying direction. A rotary encoder 28 is provided at a rotational shaft of the conveying roller 21*a*. Due to rotation of the conveying roller 21*a*, the rotary encoder 28 outputs a pulse signal associated with this rotation to the controller 100. Based on a pulse signal outputted from the rotary encoder 28, the controller 100 controls ejection timing of ink droplets from the inkjet head 1 (hereinafter referred to as the head 1).

The second conveying section 22 has a pair of conveying rollers 22*a*, 22*b* each having the same diameter as the conveying rollers 21*a*, 21*b*, and a second motor 22*c* (see FIG. 4) configured to drive the conveying rollers 22*a*, 22*b* to rotate. The conveying rollers 22*a*, 22*b* are rotated in different directions (see the arrows in FIG. 1) by the second motor 22*c*, thereby receiving paper R conveyed by the first conveying section 21, nippingly conveying this paper R in the conveying direction, and discharging the paper R on the paper tray 26.

The platen 25 is disposed to face the ejection surface 2*a* of the head 1 described later, and supports paper R that is being conveyed by the conveying mechanism 20 from below. At this time, a particular gap suitable for recording an image is formed between the upper surface of the platen 25 and the ejection surface 2*a*.

Figure 2A:
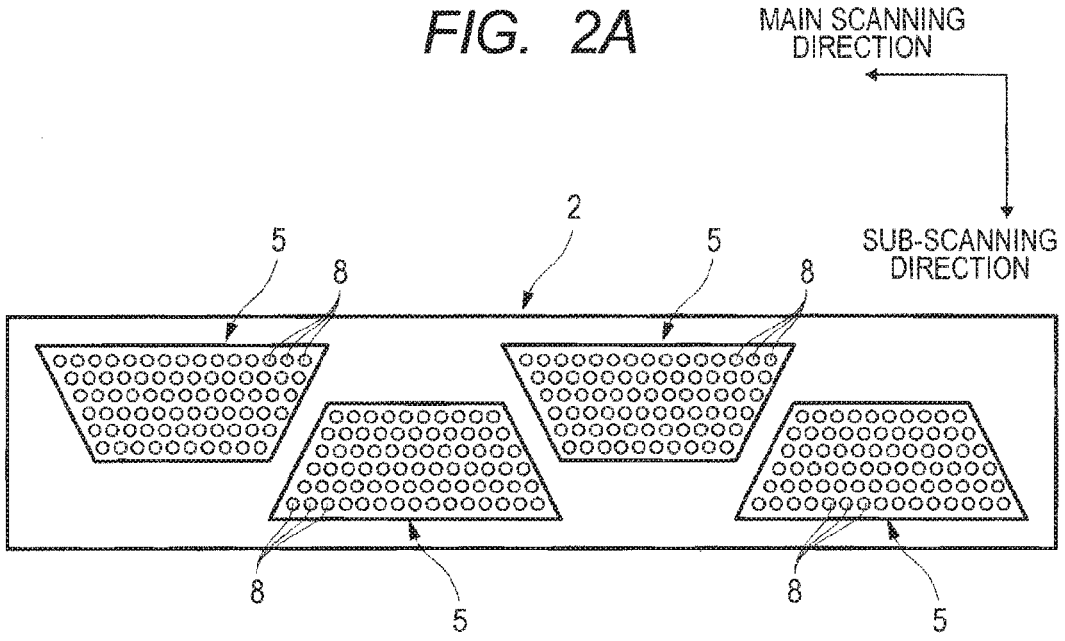
FIG. 2A is an upper view of an inkjet head shown in FIG. 1.

As shown in FIGS. 1 and 2A, the head 1 (line head) has substantially a rectangular parallelepiped shape elongated in a main scanning direction. The lower portion of the head 1 is fixed to a support frame 3. That is, the inkjet printer 101 is a line printer. The head 1 includes a head main body 2 and a reservoir unit (not shown). The head main body 2 has the ejection surface 2*a* at the lower surface thereof. A plurality of ejection ports 8 (see FIG. 2A) opens in the ejection surface 2*a*. The reservoir unit is configured to store ink supplied to the head main body 2. Ink supplied from a cartridge is temporarily stored in the reservoir unit. Here, the main scanning direction is a horizontal direction perpendicular to the conveying direction (sub-scanning direction) of paper R conveyed by the conveying mechanism 20.

As shown in FIG. 2A, in the head main body 2, a plurality of ejection ports 8 forms four ejection units 5. Each ejection unit 5 has a trapezoidal zone in which the plurality of ejection ports 8 is arranged in a matrix shape and at different positions from one another with respect to the main scanning direction. In each ejection unit 5, the plurality of ejection ports 8 arrayed in the main scanning direction forms one ejection port array, and 16 ejection port arrays are arranged in parallel to one another in the sub-scanning direction. In FIG. 2A which is the upper surface of the head main body 2, for the purpose of descriptions, the ejection ports 8 are shown by the solid lines, and only six ejection port arrays are shown schematically.

All the ejection ports 8 of the four ejection units 5 (that is, all the ejection ports 8 of the head 1) have such a relationship that all the projection points obtained by projecting the ejection ports 8 perpendicularly to an imaginary line extending in the main scanning direction are arranged at equal intervals corresponding to the resolution 600 dpi. Hence, in an image recorded on paper R, a dot array formed by a plurality of dots along the conveying direction (the sub-scanning direction) (including non-ejection dots at which ink is not ejected) corresponds to one ejection port 8. One actuator unit 30 (see FIG. 2B) is provided for each of the ejection units 5.

Figure 2B:
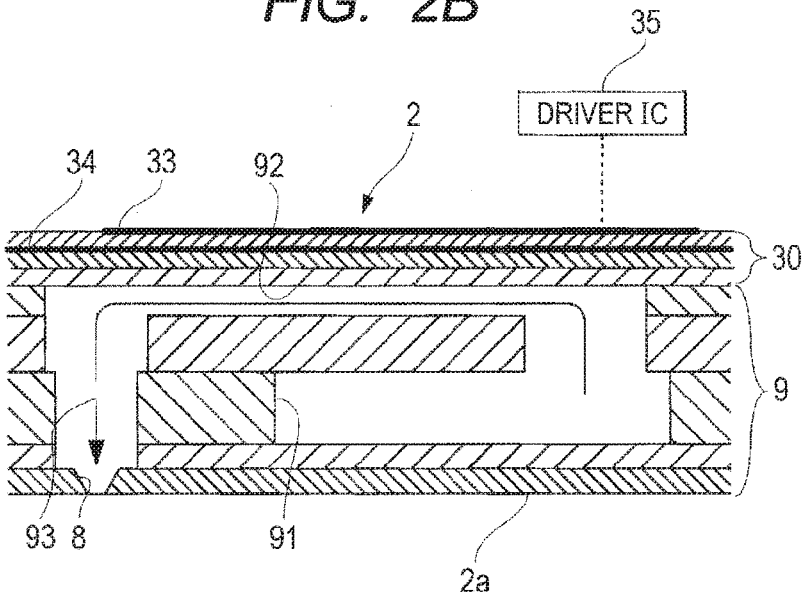
FIG. 2B is a partial enlarged view of the inkjet head.

As shown in FIG. 2B, the head main body 2 is a layered body including a channel unit 9 and the actuator unit 30 fixed to the upper surface of the channel unit 9. A manifold channel 91 in fluid communication with the reservoir unit, and a large number of individual ink channels 93 extending from the exit of the manifold channel 91 and reaching the ejection ports 8 through pressure chambers 92 are formed in the channel unit 9. The lower surface of the channel unit 9 constitutes the ejection surface 2*a* in which a large number of ejection ports 8 are arranged. Similar to the ejection ports 8, a large number of the pressure chambers 92 are arranged in the surface of the channel unit 9 fixed to the actuator unit 30.

Next, the actuator unit 30 will be described. The actuator unit 30 includes a plurality of actuators facing the respective ones of the pressure chambers 92. Each actuator selectively applies ejection energy to ink in the pressure chamber 92 at each ejection cycle that is a unit of successive time periods. Specifically, the actuator unit 30 is formed by three piezoelectric sheets made of ceramics material of lead zirconate titanate (PZT) having ferroelectricity. Each piezoelectric sheet is a continuous flat plate having a size covering the plurality of the pressure chambers 92. An individual electrode 33 is formed at each position corresponding to the pressure chamber 92 in the uppermost piezoelectric sheet. A common electrode 34 is formed between the uppermost piezoelectric sheet and the piezoelectric sheet beneath the uppermost piezoelectric sheet over the entire surface of the sheet.

The common electrode 34 is equally kept at a ground potential in the region corresponding to all the pressure chambers 92. On the other hand, the individual electrodes 33 are electrically connected to a driver IC 35. The driver IC 35 switches the potential of the individual electrode 33 between a particular positive potential V0 and the ground potential, thereby ejecting ink droplets from the ejection port 8 corresponding to the individual electrode 33. In this way, in the actuator unit 30, a portion sandwiched between the individual electrode 33 and the pressure chamber 92 functions as an individual actuator. Thus, a plurality of actuators corresponding to the number of the pressure chambers 92 is provided.

Here, the operations of the actuator unit 30 are described. The actuator unit 30 is a so-called unimorph-type actuator in which one piezoelectric sheet farthest away from the pressure chamber 92 is an active layer and the remaining two piezoelectric sheets are inactive layers. Input of a driving signal to the individual electrode 33 causes the piezoelectric sheet corresponding to this to be deformed, and pressure (ejection energy) is applied to ink in the pressure chamber 92, and an ink droplet is ejected from the ejection port 8.

In the present embodiment, the driver IC 35 outputs such a driving signal that a particular positive potential V0 is preliminarily applied to the individual electrode 33, a ground potential is applied to the individual electrode 33 each time there is an ejection request, and then the particular positive potential V0 is again applied to the individual electrode 33 at particular timing. In this case, at the timing when the individual electrode 33 becomes the ground potential, pressure of ink in the pressure chamber 92 drops so that ink is drawn from the manifold channel 91 to the individual ink channel 93. After that, at the timing when the individual electrode 33 again becomes the positive potential V0, pressure of ink in the pressure chamber 92 rises and an ink droplet is ejected from the ejection port 8.

Driving of the actuator unit 30 by the driver IC 35 will be described in detail. When paper R is conveyed by the conveying mechanism 20, in each ejection cycle, the driver IC 35 supplies the plurality of individual electrodes 33 of the actuator unit 30 with driving signals having particular driving waveforms, thereby performing the above-described switching of potential of the individual electrode 33.

In the present embodiment, there are five kinds of driving waveforms included in the driving signal supplied to the individual electrode 33 in one ejection cycle. The driver IC 35 receives, from the controller 100, six kinds of driving signals having at least one of the five kinds of driving waveforms and a waveform selection signal indicative of one of the six kinds of driving signals. The driver IC 35 selects one driving signal indicated by the waveform selection signal out of the six kinds of driving signals, and supplies the individual electrode 33 with the selected driving signal, thereby selectively ejecting ink droplets from the plurality of ejection ports 8.

As shown in FIGS. 3A to 3E, the five kinds of driving waveforms include a non-ejection waveform (FIG. 3A) having no ejection pulse P1 and four kinds of driving waveforms (FIGS. 3B to 3E) having at least one ejection pulse P1. In an ejection cycle in which a driving signal having the non-ejection waveform is applied to the individual electrode 33, the potential of the individual electrode 33 does not change and hence no ink droplet is ejected from the ejection port 8.

The four kinds of driving waveforms (FIGS. 3B to 3E) include a small droplet waveform (FIG. 3B) including one ejection pulse P1, a medium droplet waveform (FIG. 3C) also including one ejection pulse P1, a large droplet waveform (FIG. 3D) including two ejection pulses P1, and an extra-large droplet waveform (FIG. 3E) including three ejection pulses P1. The total amount of ink droplet ejected from the ejection port 8 in one ejection cycle is largest for the extra-large droplet waveform and becomes smaller in the order of the large droplet waveform, the medium droplet waveform, and the small droplet waveform. In the present embodiment, the non-ejection waveform is an example of a first driving waveform. The small droplet waveform, the medium droplet waveform, and the large droplet waveform are examples of a second driving waveform. The extra-large droplet waveform is an example of a third driving waveform.

Due to residual pressure that remains in the pressure chamber 92 after ejecting an ink droplet by the ejection pulse P1, an excess droplet separated from a main droplet of an ink droplet (hereinafter referred to as "satellite droplet") is sometimes ejected from the ejection port 8 following the main droplet. If this satellite droplet arrives at a region where a dot is not supposed to be formed, there is a possibility that image quality deteriorates. Hence, in the present embodiment, each of the small droplet waveform, the medium droplet waveform, and the large droplet waveform out of the four kinds of driving waveforms includes at least one cancel pulse P2 for removing residual pressure that remains in the pressure chamber 92 after ejecting the ink droplet by the ejection pulse P1. The cancel pulse P2 generates new pressure in the pressure chamber 92 at the timing of the cycle inverted from the cycle of residual pressure. With this operation, the residual pressure is almost cancelled by the pressure generated by the cancel pulse P2. As a result, an ink droplet ejected by the previous ejection pulse P1 tends to aggregate, thereby suppressing occurrence of a satellite droplet. On the other hand, the extra-large droplet waveform does not include the cancel pulse P2.

As shown in FIGS. 3A to 3E, each of the small droplet waveform and the medium droplet waveform has one ejection pulse P1 and one cancel pulse P2. The medium droplet waveform has a larger total amount of an ink droplet ejected from the ejection port 8 than the small droplet waveform. The interval between the ejection pulse P1 and the cancel pulse P2 of the small droplet waveform is shorter than that of the medium droplet waveform. Accordingly, when a driving signal having the small droplet waveform is applied to the individual electrode 33, an ink droplet ejected by the ejection pulse P1 is pulled back by the cancel pulse P2 and the droplet ejected from the ejection port 8 can be made small.

The large droplet waveform includes two ejection pulses P1 and two cancel pulses P2 added after each ejection pulse P1. Because the large droplet waveform has two ejection pulses P1, pressure is applied to ink in the pressure chamber 92 at the timing of applying these two ejection pulses P1. Thus, two ink droplets are ejected successively from the ejection port 8 in one ejection cycle. In this way, because two ink droplets are ejected in the ejection cycle in which the large droplet waveform is selected, the amount of ink ejected from the ejection port 8 is larger than a case where the above-described small droplet waveform or medium droplet waveform is selected.

As a means for improving an optical density value (OD value) of an image recorded on paper R, it is conceivable to increase the maximum amount of ink that can be ejected for one dot on paper R, that is, to increase the maximum amount of ink ejected from the ejection port 8 in one ejection cycle. In order to increase the maximum amount of ink ejected from the ejection port 8 in this one ejection cycle, generally, it is necessary to increase the number of the ejection pulses P1 included in the driving waveform or to extend a pulse width of the ejection pulse P1 so as to increase pressure applied to the pressure chamber 92 in one ejection pulse P1. However, if the driving waveform includes the cancel pulse P2 so as to suppress occurrence of a satellite droplet, the number of ejection pulses P1 that can be contained in one driving waveform or extension of the pulse width is limited, due to the cancel pulse P2. As a result, there is a limit to the maximum amount of ink ejected from the ejection port 8 in one ejection cycle.

Figure 3A:
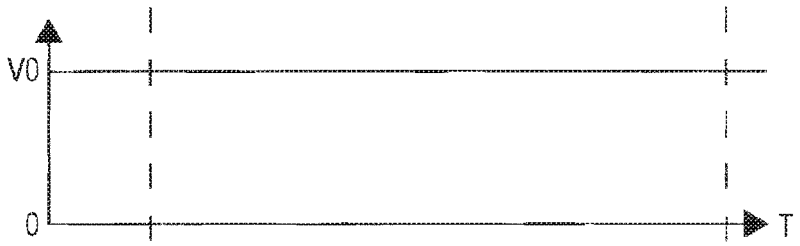
FIGS. 3A to 3E are diagrams showing driving waveforms.
Figure 3B:
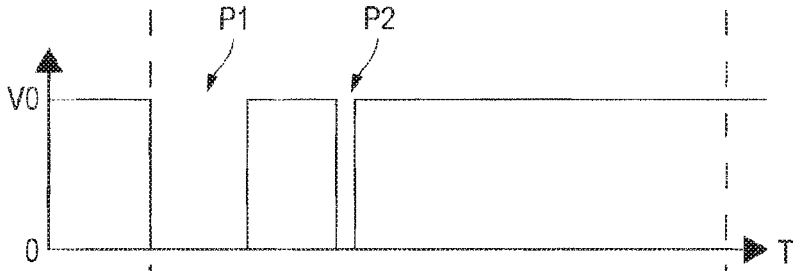
Figure 3C:
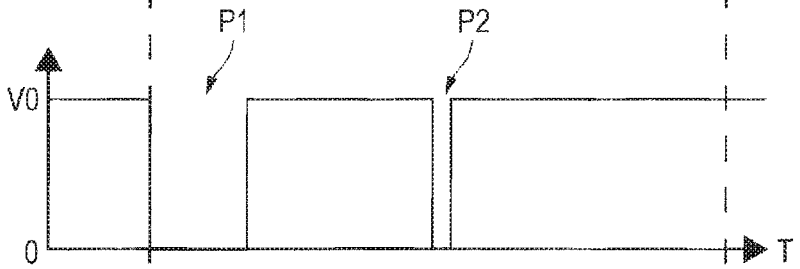
Figure 3D:
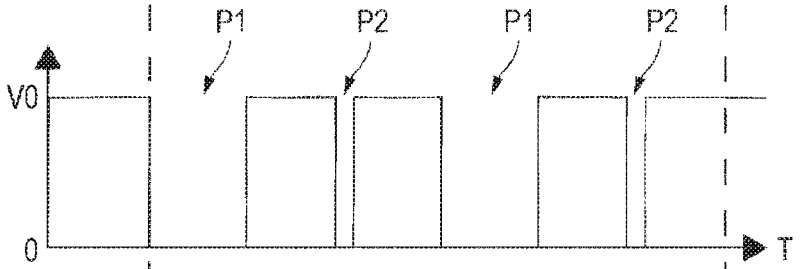
Figure 3E:
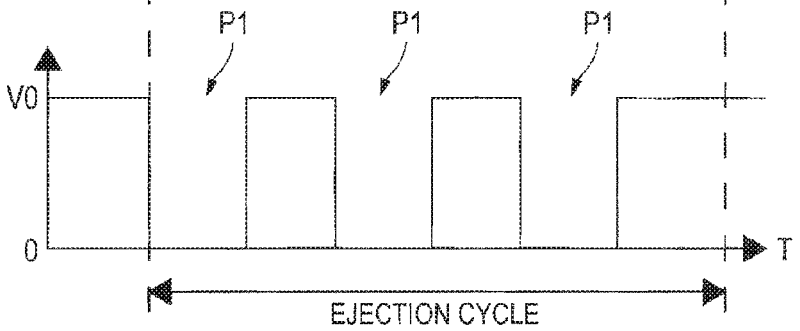

Thus, the cancel pulse P2 is not added to the extra-large droplet waveform, so as to increase degree of freedom of the number of ejection pulses P1 contained in the driving waveform or extension of the pulse width. In the present embodiment, as shown in FIG. 3E, the extra-large droplet waveform includes three ejection pulses P1. As a result, by applying a driving signal including the extra-large droplet waveform to the individual electrode 33, the total amount of ink ejected from the ejection port 8 in one ejection cycle can be increased. Because the cancel pulse P2 is not added to the extra-large droplet waveform, the amount of a satellite droplet generated at the time of ejection of an ink droplet from the ejection port 8 is larger than that of the above-described small droplet waveform, medium droplet waveform, and large droplet waveform. Hence, there is a possibility that quality of an image recorded on paper R deteriorates. The countermeasure for this issue will be described later.

Returning to FIG. 1, a paper sensor 29 is disposed at an upstream side of the head 1 in the conveying direction. The paper sensor 29 is a detection sensor for detecting whether paper R exists in a detection position that is a position at an upstream side of the head 1 in the conveying direction in the conveying path. In the present embodiment, the paper sensor 29 is a transmissive-type or reflective-type optical sensor having a light emitting portion and a light receiving portion. Based on whether the light receiving portion receives light from the light emitting portion, the paper sensor 29 detects that each of the front end and the rear end of paper R passes the detection position. As the detection result, the paper sensor 29 outputs an ON signal to the controller 100 when paper R exists in the detection position (during a period from when the front end of paper R passes the detection position until when the rear end of paper R passes the detection position), and outputs an OFF signal to the controller 100 when the paper R does not exist. Based on the detection signal from the paper sensor 29, the controller 100 determines start timing of ink ejection from the head 1. Specifically, the controller 100 determines, as the start timing of ink ejection, a time point at which a particular period has elapsed from a time point at which the paper sensor 29 detects the front end of paper R. Here, the particular period is obtained by dividing a distance between the detection position and the head 1 (more specifically, the ejection port 8 located at the farthest upstream in the conveying direction) by a conveying speed of the paper R.

For the head 1 having the head main body 2 of the above-described configuration, the controller 100 controls ink ejection interval (ejection cycle) such that ink droplets ejected from the ejection port 8 arrive at paper R at 600 dpi interval in the sub-scanning direction. That is, in the present embodiment, the resolution in the main scanning direction and the resolution in the sub-scanning direction are both 600 dpi, and a plurality of dots is formed on paper R in a matrix shape in the main scanning direction and in the sub-scanning direction.

In the above-described configuration, when paper R passes the region facing the ejection surface 2*a*, dots are formed by ink droplets ejected from the ejection ports 8 formed in the ejection surface 2*a* of the head 1 (an image is recorded) on the paper R conveyed in the conveying direction by the conveying mechanism 20. The paper R on which the image is recorded is further conveyed by the conveying mechanism 20, and is discharged onto the paper tray 26.

Next, the controller 100 will be described while referring to FIG. 4. The controller 100 includes a main control circuit 50 that controls operations of the entirety of the inkjet printer 101, an image processing circuit 60 that performs image processing, and a recording processing circuit 70 that controls the head 1 and the conveying mechanism 20.

The main control circuit 50 includes a network interface 51, a CPU (Central Processing Unit) 52, a ROM (Read Only Memory) 53, a RAM (Random Access Memory) 54, a print-data storage memory 55, a RIPCPU 56, a multivalued-data storage memory 57, and a multivalued-data transmitting circuit 58.

The network interface 51 is connected to an external terminal apparatus 200 such as a PC through a LAN or the like. The external terminal apparatus 200 stores application software configured to create data for printing, a printer driver for performing settings of processing conditions of the inkjet printer 101, and so on. The external terminal apparatus 200 starts up the printer driver, and converts data created by the application software into print data described in a PDL (page description language) and the like. The external terminal apparatus 200 then transmits the converted print data to the inkjet printer 101.

The ROM 53 stores various programs executed by the CPU 52 and the RIPCPU 56. The RAM 54 is used as a work area of the CPU 52 and the RIPCPU 56. The print-data storage memory 55 stores print data received from the external terminal apparatus 200 through the network interface 51.

Figure 5A:
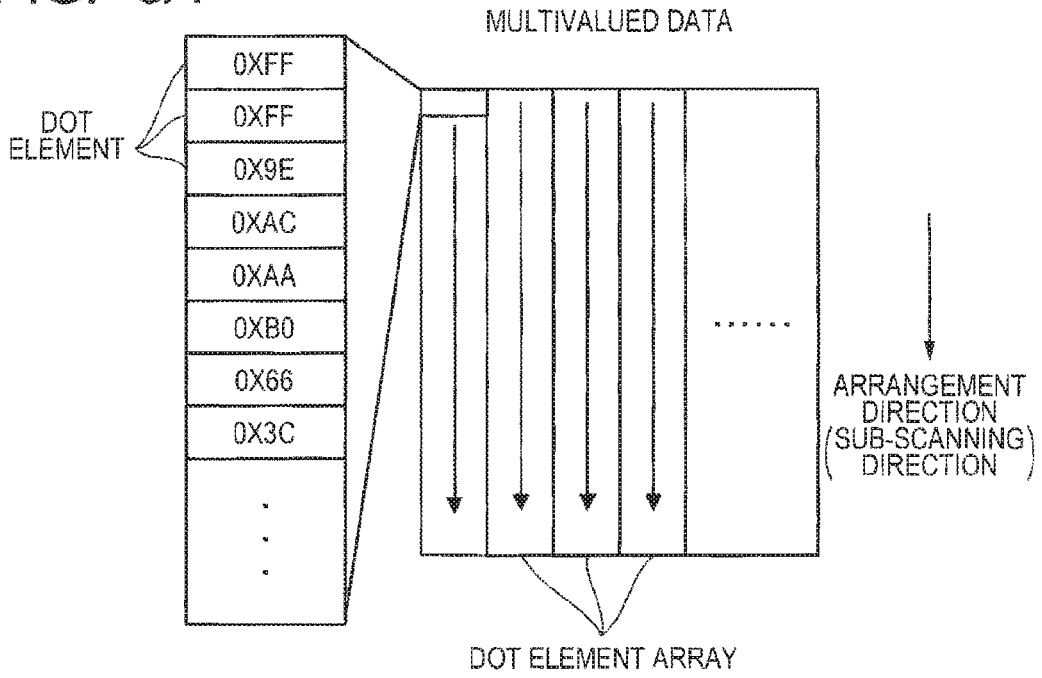
FIG. 5A is an explanatory diagram for illustrating multi-valued data.

The RIPCPU 56 performs a known RIP (Raster Image Processing) process for print data stored in the print-data storage memory 55 in accordance with instructions from the CPU 52, thereby generating multivalued image data (hereinafter referred to as "multivalued data"). As shown in FIG. 5A, the multivalued data is image data having, for each ejection port, a dot element array in which a plurality of dot elements corresponding to a plurality of dots arrayed in the conveying direction is arranged in accordance with the order (sequence) of forming the plurality of dots corresponding to the plurality of dot elements, in a dot forming region on paper R. Here, the dot forming region is a region on paper R in which ink ejected from the plurality of ejection ports 8 arrives and dots are formed. In the present embodiment, a density value represented in 256 tones is set to each dot element of the multivalued data. The multivalued data generated by the RIPCPU 56 is stored in the multivalued-data storage memory 57.

The multivalued-data transmitting circuit 58 transmits multivalued data stored in the multivalued-data storage memory 57 to the image processing circuit 60 in accordance with an instruction from the CPU 52.

The image processing circuit 60 is a circuit that performs image processing on multivalued data received from the main control circuit 50. The image processing circuit 60 includes a receiving circuit 61, a gamma correction circuit 62, a quantizing circuit 63, and an LVDS transmitting circuit 64.

The receiving circuit 61 receives multivalued data transmitted from the main control circuit 50. The gamma correction circuit 62 performs gamma correction on the multivalued data received by the receiving circuit 61. The gamma correction is a process for performing density correction (adjustment). In the present embodiment, in gamma correction, multivalued data is also converted to high tone data. Specifically, a 256-tone density value set to each dot element of multivalued data is converted to a 1024-tone density value. In this way, by performing gamma correction on multivalued data, density control such as an error diffusion process described later can be performed more precisely.

The quantizing circuit 63 performs an error diffusion process of quantizing the multivalued data that has been gamma-corrected by the gamma correction circuit 62 to obtain four-valued data of low tones. The error diffusion process is an image process of diffusing errors generated in each dot element due to reduction of a tone value to surrounding dot elements. As a modification, four-valued data may be generated from multivalued data by a known Dither process.

Figure 5B:
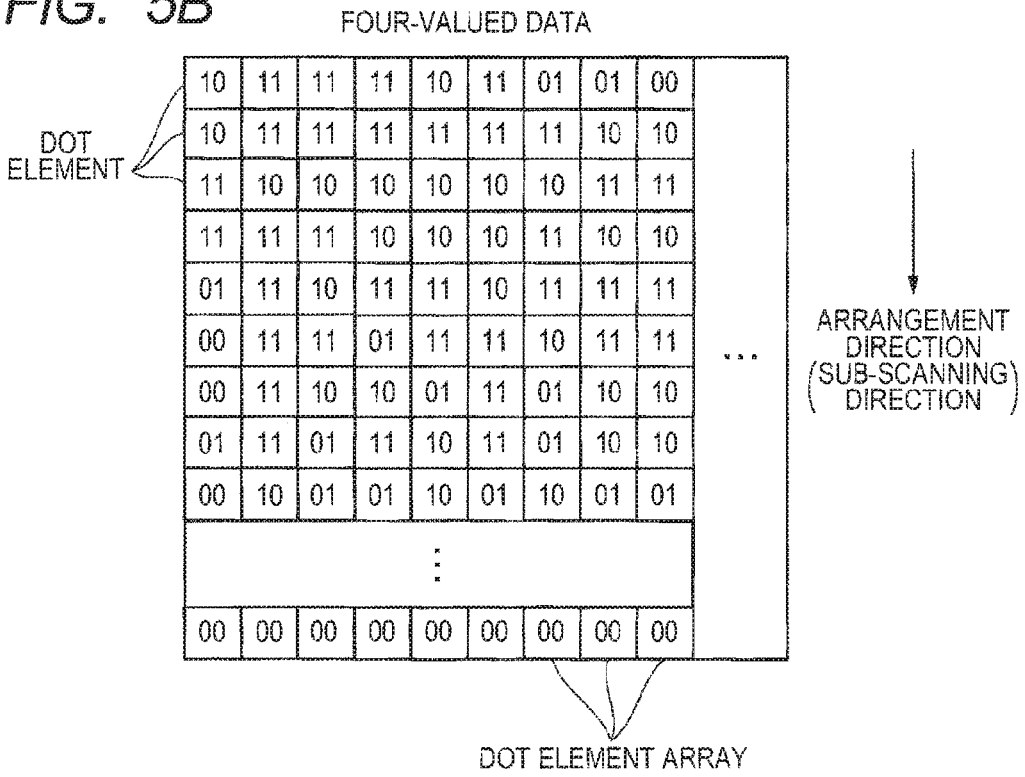
FIG. 5B is an explanatory diagram for illustrating four-valued data.

In this way, the four-valued data generated by the quantizing circuit 63 is data to which a density value represented by four tones is set for each dot element. In the four-valued data shown in FIG. 5B, four kinds of density values set to each dot element are shown by "00", "01", "10", and "11". Out of the above-described five kinds of driving waveforms, each of the four kinds of driving waveforms of the non-ejection waveform, the small droplet waveform, the medium droplet waveform, and the extra-large droplet waveform corresponds to one of the four kinds of density values. Specifically, the non-ejection waveform corresponds to a density value "00" (first density value), the small droplet waveform corresponds to a density value "01", the medium droplet waveform corresponds to a density value "10", and the extra-large droplet waveform corresponds to a density value "11" (second density value). In other words, the density value set to each dot element of four-valued data indicates the total amount of ink droplets ejected from the ejection port 8.

The LVDS transmitting circuit 64 converts the four-valued data generated by the quantizing circuit 63 to a differential signal, and transmits the differential signal to the recording processing circuit 70 by LVDS (Low voltage differential signaling).

The recording processing circuit 70 performs an image recording process of recording an image on paper R based on the four-valued data received from the image processing circuit 60. The recording processing circuit 70 includes an LVDS receiving circuit 71, a four-valued-data storage buffer 72, an edge processing circuit 73, an ejection-data storage buffer 74, a mechanism driving control circuit 75, and a head control circuit 76.

The LVDS receiving circuit 71 is an LVDS receiver that receives the differential signal transmitted from the image processing circuit 60, and returning the differential signal to four-valued data. The four-valued data received by the LVDS receiving circuit 71 is stored in the four-valued-data storage buffer 72.

The edge processing circuit 73 reads the four-valued data stored in the four-valued-data storage buffer 72, sequentially sets each dot element in this four-valued data to a target dot element A, and performs an edge process on the target dot element A. As shown in FIG. 4, the edge processing circuit 73 includes a moving average circuit 81, a filter circuit 82, a sum-of-square calculating circuit 83, a comparator circuit 84, and a liquid droplet changing circuit 85. The edge process for one target dot element A by the edge processing circuit 73 will be described below. In this description, as shown in FIG. 6A, it is assumed for simplicity that only dot elements having density values of either "00" or "01" are arranged in the four-valued data stored in the four-valued-data storage buffer 72.

As shown in FIG. 6A, a processing target region of the moving average circuit 81 is a 3×3 matrix region having the target dot element A in the center. The moving average circuit 81 calculates an average value of density values set to dot elements in the processing target region. For example, dot elements in the processing target region shown in FIG. 6A include six "01"s and three "00"s, and hence the average value of density values set to dot elements in the processing target region is ⅔.

As shown in FIG. 6B, the moving average circuit 81 creates averaged data corresponding to the four-valued data stored in the four-valued-data storage buffer 72, based on the average value of density values set to the dot elements. This process of the moving average circuit 81 is to average density values that are set to dot elements including surrounding dot elements, so that an independent point adjacent to an edge of an image does not adversely affect calculation of an edge extraction amount described later, and so on.

In the averaged data, dot elements for calculation are arranged in a matrix shape, and a calculation target dot element AA is disposed at the center of the dot elements for calculation of the matrix shape. The calculation target dot element AA corresponds to the above-described target dot element A. The density value set to each dot element of the averaged data is determined based on the average value of density values set to dot elements in the processing target region of the above-described four-valued data.

In the averaged data shown in FIG. 6B, a value "01" is set to dot elements arranged at the right side of the calculation target dot element AA. On the other hand, a value "⅔" is set to dot elements arranged at the same array as and at the left side of the calculation target dot element AA.

The filter circuit 82 performs a Sobel filter calculation using Sobel filters F1 and F2 on the averaged data generated by the moving average circuit 81.

The Sobel filter F1 shown in FIG. 6C is a differential filter relating to the main scanning direction, in which coefficients are arranged in a 3×3 matrix having the same number of rows and columns of the above-mentioned processing target region. The Sobel filter F2 shown in FIG. 6D is a differential filter relating to the sub-scanning direction, in which coefficients are arranged in a 3×3 matrix similar to the Sobel filter F1. In the Sobel filter calculation, first, the Sobel filter F1 is applied to the processing target region of the averaged data. Specifically, the coefficient located at the center of the Sobel filter F1 is multiplied by the density value set to the calculation target dot element AA of the averaged data. Further, density values set to eight dot elements located at the circumference of the calculation target dot element AA are multiplied by the respective coefficients that are applied to the dot elements located at the circumference. Then, the values obtained by multiplication are added up to obtain a filter calculation value of the calculation target dot element AA along the main scanning direction. This filter calculation value represents a density gradient value of the calculation target dot element AA along the main scanning direction. Similarly, the Sobel filter F2 is applied to the processing target region of the averaged data, thereby obtaining a filter calculation value of the calculation target dot element AA along the sub-scanning direction. This filter calculation value represents a density gradient value of the calculation target dot element AA along the sub-scanning direction.

The sum-of-square calculating circuit 83 calculates an edge extraction amount of the calculation target dot element AA based on the filter calculation value calculated by the filter circuit 82. Specifically, the sum-of-square calculating circuit 83 obtains a first square value that is the square of the filter calculation values along the main scanning direction and obtains a second square value that is the square of the filter calculation value along the sub-scanning direction, and obtains the sum of the first and second square values as the edge extraction amount. The reason for using the sum of square of the filter calculation values as the edge extraction amount is that there are cases that the filter calculation value is a negative value and it may be impossible to correctly compare the negative value with a threshold value described later.

The comparator circuit 84 compares the edge extraction amount calculated by the sum-of-square calculating circuit 83 with a preset threshold value. When the edge extraction amount is larger than or equal to the threshold value, it is determined that the target dot element A corresponding to the calculation target dot element AA is a dot element for which the set density value is to be further reduced (hereinafter referred to as "density-reduction-target dot element").

Here, in the four-valued data, dot elements having one of density values "01", "10", and "11" that the total amount of ink droplets ejected from the ejection port 8 is larger than zero are referred to as "ejection dot elements". Out of dot element groups each including a plurality of ejection dot elements, a dot element group including dot elements corresponding to arrayed dots of a number larger than or equal to a predetermined number (an integer larger than or equal to two; three in the present embodiment) in the conveying direction and dot elements corresponding to arrayed dots of a number larger than or equal to the predetermined number in a perpendicular direction is referred to as a processing-target dot element group (see FIG. 7A). The perpendicular direction is perpendicular to the conveying direction, and is the main scanning direction in the present embodiment. Also, a dot element group other than the above-mentioned dot element group is referred to as a non-processing-target dot element group (see FIG. 7B). Accordingly, the processing-target dot element group includes a dot element group corresponding to a matrix region of [predetermined number] X [predetermined number] (for example, 2×2 or 3×3) and a dot element group corresponding to a matrix region of [predetermined number] X [number larger than predetermined number] (for example, 2×3), in which the predetermined number of ejection dots are arranged in the conveying direction and in the perpendicular direction on paper R. The processing-target dot element group also includes a dot element group for forming a straight line image extending in an oblique direction on paper R (a direction intersecting the conveying direction and the perpendicular direction), the dot element group including dot elements corresponding to arrayed ejection dots of a number larger than or equal to the predetermined number in the conveying direction and dot elements corresponding to arrayed ejection dots of a number larger than or equal to the predetermined number in the perpendicular direction. That is, the processing-target dot element group includes not only a vertical line image of width larger than or equal to the predetermined number of dots and a horizontal line image of width larger than or equal to the predetermined number of dots but also a dot element group for forming an oblique line image in which there is a portion where at least the predetermined number (for example, 2) of ejection dots are arrayed in the conveying direction.

In the present embodiment, the processing-target dot element group is a dot element group for forming a thick line image larger than or equal to three-dot width, for example, including a dot element group corresponding to a 3×3 matrix region, and is a dot element group including at least one dot element corresponding to a part other than edges of an image. The non-processing-target dot element group is, for example, a dot element group for forming a thin line image of one-dot width, and is a dot element group in which all dot elements correspond to edges of an image. In other words, the processing-target dot element group is a dot element group in which at least one dot element is determined as the density-reduction-target dot element in the edge process performed by the edge processing circuit 73. On the other hand, the non-processing-target dot element group is a dot element group that does not include a dot element that is determined as the density-reduction-target dot element.

Figure 7A:
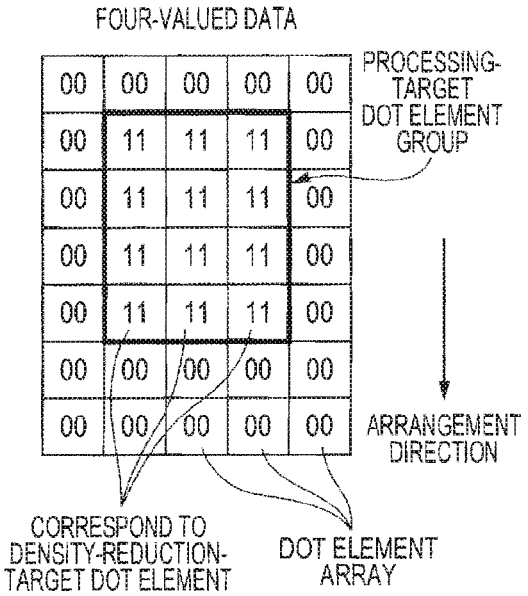
FIGS. 7A and 7B are explanatory diagrams each showing four-valued data before an edge process.
Figure 7B:
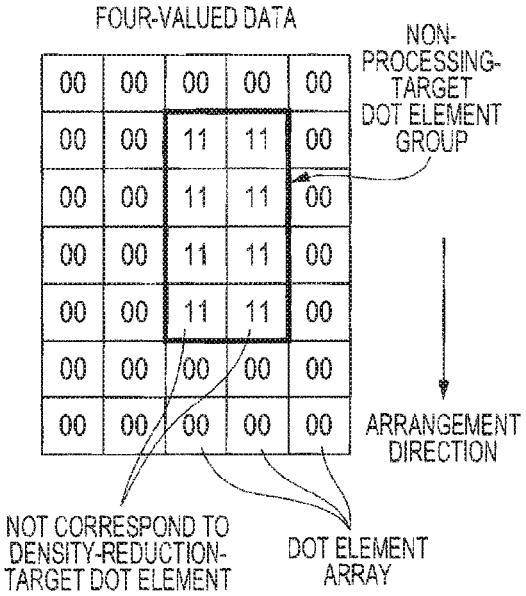

The above-mentioned preset threshold value is set to be smaller than or equal to a lower limit value of the edge extraction amount expected when the target dot element A is a dot element located at an edge of an image in dot elements of the processing-target dot element group, and to be larger than a higher limit value of the edge extraction amount expected when the target dot element A is a dot element located at an edge of an image in dot elements of the non-processing-target dot element group. Thus, as shown in FIG. 7A, it is determined that dot elements on the edge of the image in the processing-target dot element group are the density-reduction-target dot elements, whereas, as shown in FIG. 7B, it is determined that dot elements on the edge of the image in the non-processing-target dot element group are not the density-reduction-target dot elements.

Figure 7C:
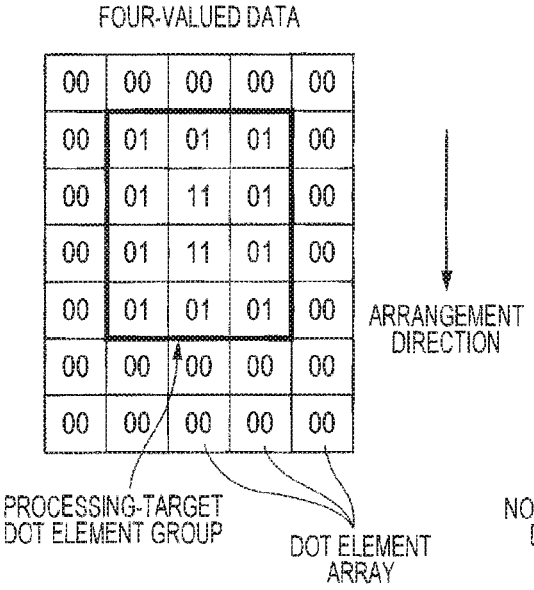
FIGS. 7C and 7D are explanatory diagrams each showing four-valued data after the edge process.
Figure 7D:
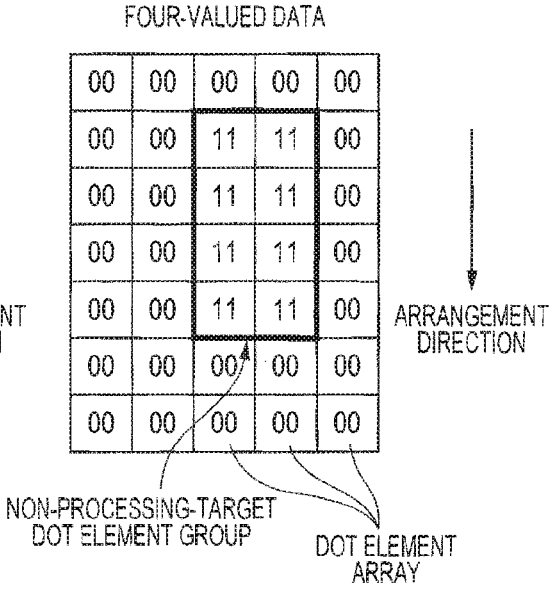

When it is determined that the target dot element A is the density-reduction-target dot element based on the determination result of the comparator circuit 84, the liquid droplet changing circuit 85 executes a process of reducing the density value set to the target dot element A. For example, when the density value set to the target dot element A is "10" or "11", the density value is reduced to "01". As shown in FIG. 7C, this process reduces the density value set to dot elements located at the edge of the processing-target dot element group, and hence reduces the amount of ink ejected to the edge of the image. As a result, the edge of the image can be made sharper without blurring (for example, occurrence of feathering). On the other hand, as shown in FIG. 7D, density values set to dot elements located at the edge of the non-processing-target dot element group are maintained. This suppresses a situation that density values are reduced by the edge process and an image formed on paper R becomes unclear. In addition, if the density values set to dot elements located at the edge of the non-processing-target dot element group were reduced by the edge process, dot elements having density values "11" would not exist in the non-processing-target dot element group of a thin line image of two-dot width and so on, which reduces the optical density of the image. However, in the present embodiment, as described above, because the density values set to dot elements located at the edge of the non-processing-target dot element group are maintained, a decrease of the optical density of an image can be suppressed.

The edge processing circuit 73 repeats the above-described operation while sequentially setting each dot element of four-valued data to the target dot element. The four-valued data for which the edge processing circuit 73 has performed the edge process is stored in the ejection-data storage buffer 74 as ejection data.

Returning to FIG. 4, based on a control signal from the CPU 52, the mechanism driving control circuit 75 controls the first motor 21*c* and the second motor 22*c* of the conveying mechanism 20 to perform a process (relative moving process) of conveying paper R in the conveying direction (moving the paper R relative to the head 1).

In accordance with control signals from the CPU 52, the head control circuit 76 controls the head 1 such that an image corresponding to ejection data stored in the ejection-data storage buffer 74 is recorded on paper R that is conveyed by the conveying mechanism 20. Specifically, the head control circuit 76 includes a rearranging circuit 86, a driving-waveform storage circuit 87, a driving-signal output circuit 88, and a waveform-selection-signal output circuit 89.

Figure 8:
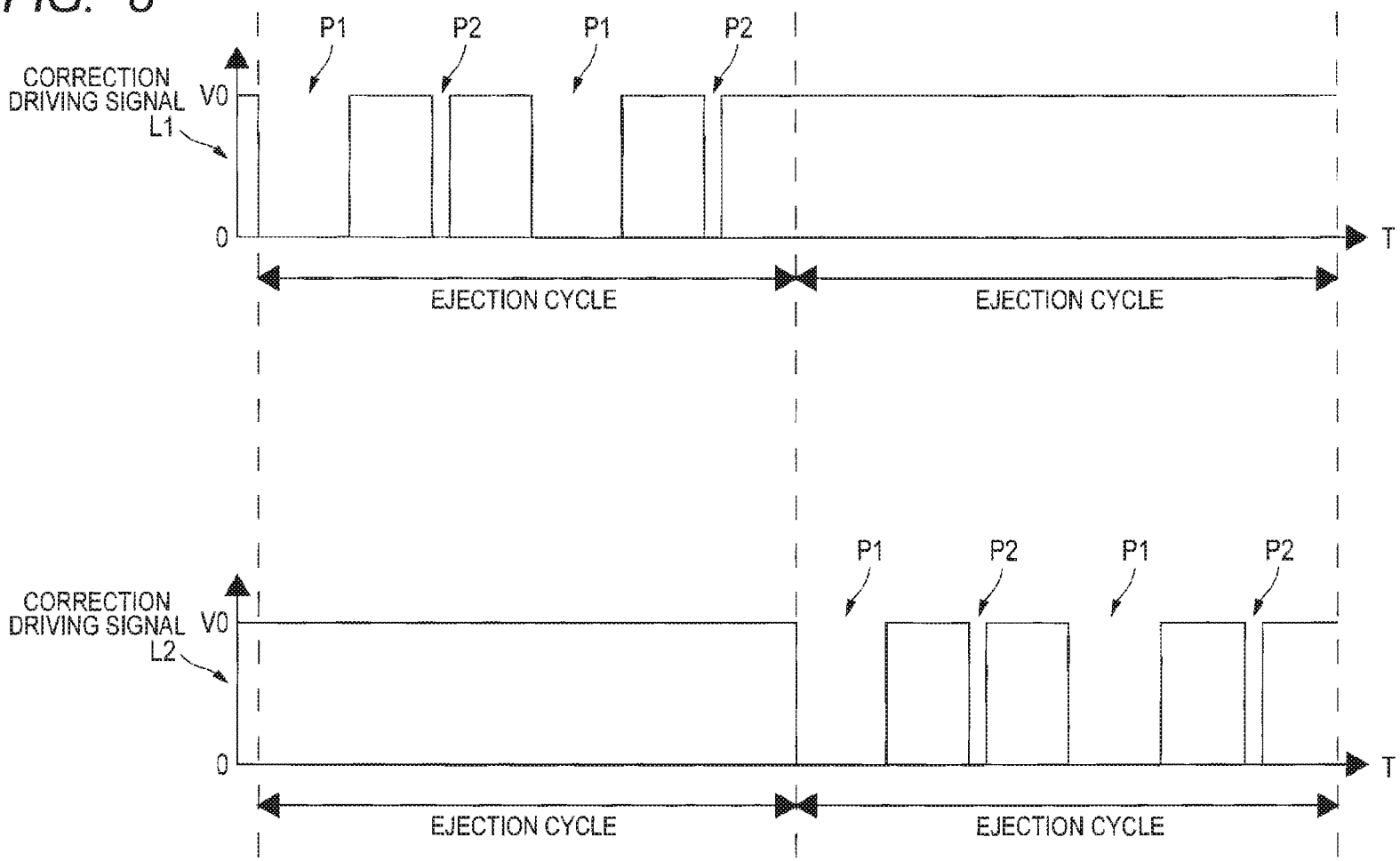
FIG. 8 shows diagrams for illustrating correction driving signals.

The rearranging circuit 86 rearranges ejection data stored in the ejection-data storage buffer 74 to obtain data tailored to the arrangement of the ejection ports 8 of the head 1. The driving-waveform storage circuit 87 stores the above-mentioned five kinds of driving waveforms defining ink ejection amount at each ejection cycle for ejecting ink from each ejection port 8 of the head 1. The driving-signal output circuit 88 outputs, to the driver IC 35, six kinds of driving signals including the driving waveforms stored in the driving-waveform storage circuit 87. The six kinds of driving signals include: the four kinds of driving signals including one of the four kinds of driving waveforms of a non-ejection waveform, a small droplet waveform, a medium droplet waveform, and an extra-large droplet waveform; and two-kinds of correction driving signals including a large droplet waveform. Each of the four kinds of driving signals includes one driving waveform, and its cycle corresponds to one ejection cycle. On the other hand, as shown in FIG. 8, each of the two kinds of correction driving signals L1 and L2 includes two driving waveforms of a large droplet waveform and a non-ejection waveform, and its cycle corresponds to two ejection cycles. That is, the correction driving signal spans two ejection cycles. Although only two ejection cycles are shown in FIG. 8, the two kinds of correction driving signals L1 and L2 are outputted continuously. In each correction driving signal, the large droplet waveform and the non-ejection waveform are outputted alternately, and the two kinds of correction driving signals L1 and L2 have opposite phases (shifted 180 degrees) from each other. That is, in a certain ejection cycle, the driving-signal output circuit 88 is configured to output a portion corresponding to the large droplet waveform by one correction driving signal and to output a portion corresponding to the non-ejection waveform by the other correction driving signal. The driving-signal output circuit 88 outputs these six kinds of driving signals to the driver IC 35 continuously.

The waveform-selection-signal output circuit 89 performs a waveform selecting process of selecting one of the above-mentioned six kinds of driving signals for each of a plurality of dot elements, based on density values set to respective ones of the plurality of dot elements in ejection data. The driving signal selected for each of the dot elements is a driving waveform included in the driving signal supplied to the individual electrode 33 corresponding to each ejection port 8 when forming a dot corresponding to the dot element on paper R.

The waveform-selection-signal output circuit 89 basically selects a non-ejection waveform (see FIG. 3A) for a dot element to which the density value "00" is set, a small droplet waveform (see FIG. 3B) for a dot element to which the density value "01" is set, a medium droplet waveform (see FIG. 3C) for a dot element to which the density value "10" is set, and an extra-large droplet waveform (see FIG. 3E) for a dot element to which the density value "11" is set.

As mentioned above, because the extra-large droplet waveform does not have the cancel pulse P2, a large amount of satellite droplet may be produced when an ink droplet is ejected from the ejection port 8. At this time, when no subsequent ink droplet is ejected from that ejection port 8, a satellite droplet arrives at a position (dot) at which ink is not supposed to arrive, which considerably affects the image quality. On the other hand, when a subsequent ink droplet is ejected from that ejection port 8, a satellite droplet arrives at a position at which an ink droplet arrives (a position at which the main droplet of the subsequent ink droplet arrives), which does not affect the image quality very much.

As described above, due to the edge process by the edge processing circuit 73, in four-valued data, density values set to dot elements located at the edge of the processing-target dot element group are changed to density values having a smaller total amount of ink droplet ejected from the ejection port 8. Accordingly, regarding the processing-target dot element group, even if the extra-large droplet waveform is selected for a certain dot element by the waveform-selection-signal output circuit 89, a driving waveform other than the non-ejection waveform is always selected for the dot element corresponding to the dot that is formed subsequent to the dot corresponding to the certain dot element. Thus, a satellite droplet does not affect the image quality very much.

However, in four-valued data, regarding density values set to dot elements located at the edge of the non-processing-target dot element group, the density values are not reduced by the edge process performed by the edge processing circuit 73. Hence, regarding the non-processing-target dot element group, if the waveform-selection-signal output circuit 89 selects the extra-large droplet waveform for a certain dot element and if the non-ejection waveform is selected for the dot element corresponding to the dot that is formed subsequent to the dot corresponding to the certain dot element, there is a possibility that the image quality deteriorates due to a satellite droplet.

Hence, in the present embodiment, the waveform-selection-signal output circuit 89 sets, as a correction-target dot element, a dot element "11" having a subsequent dot element "00" in each dot element array of ejection data. For this correction-target dot element, the waveform-selection-signal output circuit 89 does not select the extra-large droplet waveform but selects the large droplet waveform having a smaller amount of satellite droplet than the extra-large droplet waveform.

In this way, the waveform-selection-signal output circuit 89 outputs the waveform selection signal indicative of one of the above-mentioned six kinds of driving signals to the driver IC 35, based on the driving waveform selected for each dot element of ejection data.

Here, when forming a dot corresponding to the correction-target dot element, occurrence of a satellite droplet could be prevented by supplying the individual electrode 33 with a driving signal having a long driving waveform in which the ejection pulse P1 is arranged in a period of two or more ejection cycles. In the case of the long waveform spanning two ejection cycles, however, it is difficult to set waveform parameters for ejecting a desired ink droplet in the corresponding dots (the number and pulse width of the ejection pulses P1, the interval between the ejection pulses P1, and so on), which requires an additional amount of development and evaluation work. In the present embodiment, however, each of the above-mentioned five kinds of driving waveforms is a driving waveform that completes within one ejection cycle, and hence such development and evaluation work is not required.

The waveform-selection-signal output circuit 89 will be described below while referring to FIGS. 9 and 10. In the below description, it is assumed that dot elements of the same arrangement order in each dot element array of ejection data correspond to dots formed in the same ejection cycle.

First, the operations of the waveform-selection-signal output circuit 89 will be described while referring to FIG. 9. Here, the operation of the waveform-selection-signal output circuit 89 for the dot element array corresponding to a certain ejection port 8 will be described.

Figure 9:
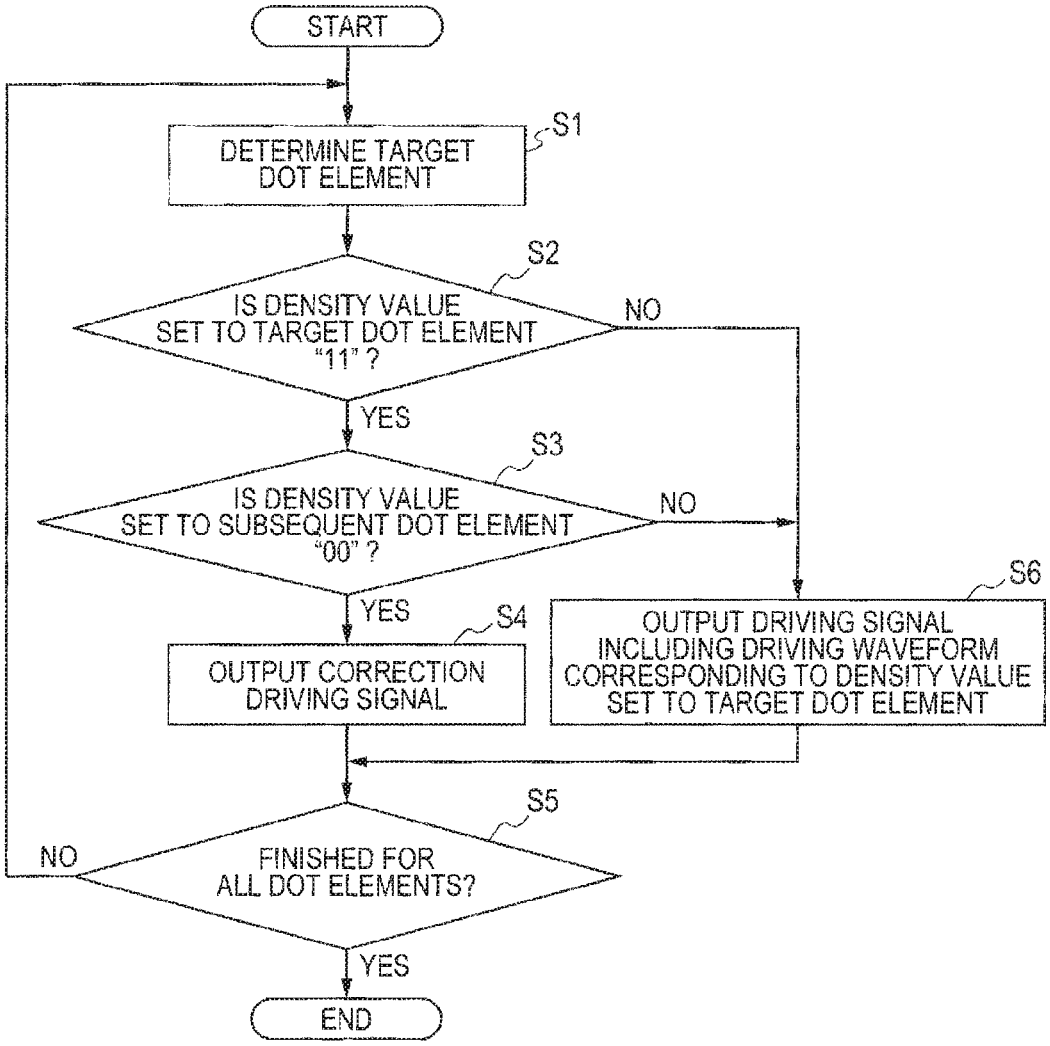
FIG. 9 is a flowchart for illustrating operations of a waveform-selection-signal output circuit.

As shown in FIG. 9, first, the waveform-selection-signal output circuit 89 determines, as the target dot element, a dot element corresponding to the earliest dot in the formation order in the dot element array of ejection data stored in the ejection-data storage buffer 74 (S1). The waveform-selection-signal output circuit 89 then determines whether the density value set to this target dot element is "11" which corresponds to the extra-large droplet waveform (S2). In response to determining that the density value set to the target dot element is "11" (S2: YES), the waveform-selection-signal output circuit 89 determines whether the density value set to the dot that is just after the dot corresponding to the target dot element in the formation order (hereinafter also referred to as "subsequent dot element") is "00" which corresponds to the non-ejection waveform (S3).

In response to determining that the density value set to the subsequent dot element is "00" (S3: YES), the waveform-selection-signal output circuit 89 determines the target dot element as the correction-target dot element and outputs, to the driver IC 35, a waveform selection signal indicative of one of the above-mentioned two kinds of correction driving signals L1 and L2 (S4). At this time, the waveform-selection-signal output circuit 89 outputs a waveform selection signal indicative of a correction driving signal that is the large droplet waveform in the ejection cycle corresponding to the target dot element and that is the non-ejection waveform in the ejection cycle corresponding to the subsequent dot element, out of the two-kinds of correction driving signals L1 and L2. That is, the waveform-selection-signal output circuit 89 selects the large droplet waveform for the target dot element, and selects the non-ejection waveform for the subsequent dot element.

Next, the waveform-selection-signal output circuit 89 determines whether a driving waveform is selected for all the dot elements of the dot element array (S5). In response to determining that a driving waveform is selected for all the dot elements (S5: YES), this process is ended. On the other hand, in response to determining that a driving waveform has not been selected for at least one dot element of the dot element array (S5: NO), the process returns to S1, and the waveform-selection-signal output circuit 89 determines, as the target dot element, the dot element corresponding to the earliest dot in the formation order in the dot element array out of dot elements for which no driving waveform has been selected yet.

On the other hand, in response to determining that the density value set to the target dot element in S2 is other than "11" (S2: NO) or in response to determining that the density value set to the subsequent dot element in S3 is other than "00" (S3: NO), the waveform-selection-signal output circuit 89 selects the waveform selection signal indicative of the driving signal corresponding to the density value set to the target dot element, and outputs the waveform selection signal to the driver IC 35 (S6). That is, the waveform-selection-signal output circuit 89 selects the waveform selection signal indicative of the driving signal including the non-ejection waveform when the density value set to the target dot element is "00", selects the waveform selection signal indicative of the driving signal including the small droplet waveform when the density value set to the target dot element is "01", selects the waveform selection signal indicative of the driving signal including the medium droplet waveform when the density value set to the target dot element is "10", and selects the waveform selection signal indicative of the driving signal including the extra-large droplet waveform when the density value set to the target dot element is "11". When S6 ends, the process moves to S5.

The waveform-selection-signal output circuit 89 executes the above-described operation for each dot element array, so that a driving waveform is selected for each dot element of ejection data. Thus, for example, when forming dots corresponding to respective dot elements of the ejection data shown in FIG. 10A, the driver IC 35 supplies driving signals shown in FIG. 10B to the individual electrode 33 of each ejection port 8. In FIG. 10B, "0" denotes a driving signal including the non-ejection waveform, "S" denotes a driving signal including the small droplet waveform, "M" denotes a driving signal including the medium droplet waveform, "T" denotes a driving signal including the extra-large droplet waveform, and "L1" and "L2" denote the two kinds of correction driving signals. As can be seen from FIG. 10B, the head 1 is supplied with driving signals having the extra-large droplet waveform having a large total amount of ink droplets per ejection cycle, which improves the optical density of the image formed on paper R. On the other hand, no driving signal having the non-ejection waveform is supplied to the head 1 subsequent to the driving signal having the extra-large droplet waveform, which suppresses deterioration of the image quality due to satellite droplets.

As described above, according to the present embodiment, the head 1 is supplied with a driving signal including the extra-large droplet waveform having a large total amount of ink droplets ejected from the ejection port 8, thereby increasing the total amount of ink that can arrive at one dot on paper R and hence improving the optical density of the image. Although the extra-large droplet waveform is a driving waveform that may produce a large amount of satellite droplet, the extra-large droplet waveform is not selected for a dot element corresponding to a dot having a subsequent dot at which no ink droplet is ejected. Accordingly, a satellite droplet only arrives at a dot at which the main droplet of an ink droplet arrives on paper R, which suppresses deterioration of the image quality due to satellite droplets.

The waveform-selection-signal output circuit 89 selects, for the correction-target dot element, the large droplet waveform having the second largest total amount of droplets, ejected from the ejection port 8, after the extra-large droplet waveform. Hence, a decrease of the optical density of an image can be suppressed.

Regarding an image having a large region such as a thick line out of images recorded on paper R, blurring of the edge of the image is alleviated and sharpened by the edge process. On the other hand, regarding an image having a small region such as a thin line out of images recorded on paper R, the edge process is not executed and hence a decrease of the optical density of the image can be suppressed.

While the disclosure has been described in detail with reference to the above aspects thereof, it would be apparent to those skilled in the art that various changes and modifications may be made therein without departing from the scope of the claims.

In the above-described embodiment, each of the first conveying section 21 and the second conveying section 22 includes a pair of conveying rollers. However, the configuration is not limited to this. For example, each of the first conveying section 21 and the second conveying section 22 may be a conveying belt looped around a drive roller and a follow roller.

In the above-described embodiment, for the correction dot element, the waveform-selection-signal output circuit 89 is configured to select the large droplet waveform, not the extra-large droplet waveform. However, the configuration is not limited to this as long as the waveform-selection-signal output circuit 89 selects a driving waveform that produces a smaller amount of satellite droplet than the extra-large droplet waveform. For example, the non-ejection waveform, the small droplet waveform, or the medium droplet waveform may be selected for the correction dot element. At this time, the driving-waveform storage circuit 87 does not need to store the large droplet waveform as the driving waveform but only needs to store the four kinds of driving waveforms correspond to four-tone density values of four-valued data.

In the above-described embodiment, the inkjet printer 101 is a line printer that performs recording of an image in a state where the head 1 is fixed. However, this disclosure can also be applied to a so-called serial printer that performs recording while scanning a head in a direction intersecting the conveying direction of paper R. In this case, by moving the head in the direction intersecting the conveying direction, the relative moving mechanism (a head moving mechanism such as a carriage) moves paper R in a relative moving direction that is parallel to the ejection surface, relative to the head. In this case, the relative moving direction is the main scanning direction in which the head moves.

The extra-large droplet waveform (third driving waveform) may include a cancel pulse. The small droplet waveform, the medium droplet waveform, and the large droplet waveform (second driving waveform) do not always need to include a cancel pulse. That is, the extra-large droplet waveform may be a waveform that produces a larger total amount of ink droplets ejected from the ejection port 8 than the second driving waveform and that produces a larger amount of a satellite droplet than the second driving waveform.

In the above-described embodiment, the edge processing circuit 73 is configured to perform the edge process for four-valued data. However, the edge processing circuit 73 may be configured not to perform the edge process for four-valued data. In this case, too, by selecting the first driving waveform or the second driving waveform, not the third driving waveform, for the correction dot element, deterioration of the image quality due to satellite droplets can be suppressed.

This disclosure can be applied to a liquid ejecting apparatus that ejects liquid other than ink. This disclosure can also be applied to a facsimile apparatus, a copier, and so on, in addition to a printer.

What is claimed is:

1. A liquid ejecting apparatus comprising:

a liquid ejecting head having an ejection surface having a plurality of ejection ports configured to eject liquid droplets;

a relative moving mechanism configured to cause relative movement of a recording medium relative to the liquid ejecting head in a relative moving direction parallel to the ejection surface;

an image data memory configured to store image data having, for each of the plurality of ejection ports, a dot element array in which a plurality of dot elements corresponding to a plurality of dots on a recording medium is arrayed in formation order of forming the plurality of dots, the plurality of dots being formed by liquid droplets ejected from a corresponding one of the plurality of ejection ports, the image data having a dot element value for each of the plurality of dot elements, the dot element value being indicative of a total amount of liquid droplets ejected from the corresponding one of the plurality of ejection ports, the dot element value being one of a plurality of density values of which the total amount of liquid droplets is different from each other;

a driving waveform memory configured to store a plurality of kinds of driving waveforms including:

a first driving waveform corresponding to a first density value of which the total amount of liquid droplets is zero, the first driving waveform being one of the plurality of density values;

a second driving waveform corresponding to a density value of which the total amount of liquid droplets is larger than zero; and a third driving waveform corresponding to a second density value of which the total amount of liquid droplets is larger than zero, the second driving waveform being one of the plurality of density values, the total amount of liquid droplets by the third driving waveform being larger than the total amount of liquid droplets by the second driving waveform, the third driving waveform producing a larger amount of a satellite droplet than the second driving waveform, the satellite droplet being separated from a main droplet of a liquid droplet when the liquid droplet is ejected from one of the plurality of ejection ports; and a controller configured to control the liquid ejecting head and the relative moving mechanism, the controller being configured to perform:

a relative moving process of controlling the relative moving mechanism to cause relative movement of a recording medium relative to the liquid ejecting head in the relative moving direction;

a waveform selecting process of selecting one of the plurality of kinds of driving waveforms for each of the plurality of dot elements, based on a density value set to each of the plurality of dot elements in the image data, the waveform selecting process comprising, for the dot element array of each of the plurality of ejection ports:

determining whether a dot element corresponding to a target dot has the second density value and determining whether a subsequent dot element corresponding to a subsequent dot has the first density value and, when both determinations are positive, setting the dot element corresponding to the target dot as a correction-target dot element, the subsequent dot being subsequent to the target dot in the formation order; and selecting one of the first driving waveform and the second driving waveform as a driving waveform of the correction-target dot element; and a driving-signal supplying process of supplying the liquid ejecting head with a driving signal having one of the first, second, and third driving waveforms selected for each of the plurality of dot elements by the waveform selecting process, and selectively ejecting liquid droplets from the plurality of ejection ports onto the recording medium that moves relative to the liquid ejecting head.

2. The liquid ejecting apparatus according to claim 1, wherein the second driving waveform includes a plurality of kinds of second driving waveforms;

wherein the driving waveform memory stores the plurality of kinds of second driving waveforms; and wherein, in the waveform selecting process, the controller is configured to select, as the driving waveform of the correction-target dot element, a driving waveform corresponding to a largest total amount of liquid droplets in the plurality of kinds of second driving waveforms.

3. The liquid ejecting apparatus according to claim 1, wherein the image data includes the plurality of dot elements arranged in a matrix shape, the plurality of dot elements corresponding to a plurality of dots arranged in the matrix shape on the recording medium, the matrix shape including arrays in the relative moving direction and arrays in a perpendicular direction perpendicular to the relative moving direction; and wherein the controller is configured to perform:

determining, as a processing-target dot element group, a dot element group formed by non-zero dot elements that are arranged continuously by at least a predetermined number both in the relative moving direction and in the perpendicular direction, the non-zero dot elements being dot elements having density values larger than zero, the predetermined number being an integer larger than or equal to two; and changing density values of dot elements located at an edge of an image in the processing-target dot element group into smaller density values.

4. The liquid ejecting apparatus according to claim 3, wherein the controller is configured to perform:

determining a dot element group other than the processing-target dot element group as a non-processing-target dot element group; and maintaining density values of dot elements in the non-processing-target dot element group.

5. The liquid ejecting apparatus according to claim 1, wherein, before the waveform selecting process, the controller is configured to perform:

calculating an edge extraction amount of each of the plurality of dot elements based on filter calculation;

comparing the edge extraction amount with a threshold value;

when the edge extraction amount is larger than or equal to the threshold value, determining a corresponding dot element as a density-reduction-target dot element; and reducing a density value set to the density-reduction-target dot element to a smaller density value.

6. The liquid ejecting apparatus according to claim 1, wherein the liquid ejecting head has pressure chambers in fluid communication with respective ones of the plurality of ejection ports;

wherein the second driving waveform includes a cancel pulse for removing residual pressure that remains in the pressure chambers, the cancel pulse being applied after an ejection pulse for ejecting a droplet; and wherein the third driving waveform includes no cancel pulse.

7. The liquid ejecting apparatus according to claim 1, wherein the relative moving mechanism comprises a conveying mechanism configured to convey a recording medium along a conveying direction that is the relative moving direction; and wherein the liquid ejecting head is a line head having a shape elongated in a perpendicular direction perpendicular to the conveying direction; and wherein liquid ejecting apparatus is configured to perform recording of an image in a state where the liquid ejecting head is fixed.

8. The liquid ejecting apparatus according to claim 1, wherein the waveform selecting process comprises selecting one of a first correction driving signal and a second correction driving signal for the target dot and the subsequent dot, each of the first correction driving signal and the second correction driving signal spanning two ejection cycles and including an ejection waveform and a non-ejection waveform;

wherein, in each of the first correction driving signal and the second correction driving signal, the ejection waveform and the non-ejection waveform are outputted alternately; and wherein the first correction driving signal and the second correction driving signal have opposite phases from each other.

9. The liquid ejecting apparatus according to claim 8, wherein the driving waveform memory is configured to store, as the second driving waveform, a single-droplet waveform including one ejection pulse and one cancel pulse after the ejection pulse, and a double-droplet waveform including two ejection pulses and two cancel pulses after respective ones of the two ejection pulses, the cancel pulse being for removing residual pressure that remains in a pressure chamber, the cancel pulse being applied after the ejection pulse for ejecting a droplet; and wherein the driving waveform memory is configured to store, as the third driving waveform, a triple-droplet waveform including three ejection pulses and no cancel pulse; and wherein each of the first correction driving signal and the second correction driving signal includes the double-droplet waveform, as the ejection waveform.

* * * * *